US006792218B2

(12) United States Patent
Tungate, Jr. et al.

(10) Patent No.: US 6,792,218 B2
(45) Date of Patent: Sep. 14, 2004

(54) METHOD OF COMPENSATING FOR LOW TONER CONSUMPTION

(75) Inventors: Stanley C. Tungate, Jr., Lexington, KY (US); Cary Ravitz, Lexington, KY (US); Thomas G. Twardeck, Lexington, KY (US); Albert M. Carter, Jr., Richmond, KY (US); Gary A. Denton, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/167,376

(22) Filed: Jun. 11, 2002

(65) Prior Publication Data

US 2003/0228159 A1 Dec. 11, 2003

(51) Int. Cl.[7] ..... G03G 15/08; G03G 21/00

(52) U.S. Cl. ..... 399/29; 399/127

(58) Field of Search ..... 399/25, 27, 29, 399/127

(56) References Cited

U.S. PATENT DOCUMENTS

| | | | | |
|---|---|---|---|---|
| 4,736,255 | A | | 4/1988 | Miura et al. |
| 4,786,942 | A | | 11/1988 | Kusumoto et al. |
| 4,945,388 | A | * | 7/1990 | Tange et al. |
| 4,967,231 | A | | 10/1990 | Hosoya et al. |
| 4,992,831 | A | | 2/1991 | Kunishi |
| 5,168,293 | A | | 12/1992 | Ogasawara et al. |
| 5,486,901 | A | * | 1/1996 | Fukuchi et al. |
| 5,504,557 | A | | 4/1996 | Morita |
| 5,528,346 | A | | 6/1996 | Kim et al. |
| 5,550,615 | A | * | 8/1996 | Szlucha |
| 5,625,394 | A | | 4/1997 | Fukuda et al. |
| 5,802,419 | A | * | 9/1998 | Sakurai et al. ..... 399/27 |
| 6,112,036 | A | * | 8/2000 | Shinohara |
| 6,631,249 | B2 | * | 10/2003 | Katsumi et al. |
| 2003/0107783 | A1 | * | 6/2003 | Mitamura |

FOREIGN PATENT DOCUMENTS

| | | | | |
|---|---|---|---|---|
| JP | 03233487 | A | * 10/1991 | ..... G03G/21/00 |
| JP | 06003890 | A | * 1/1994 | ..... G03G/15/00 |
| JP | 06186842 | A | * 7/1994 | ..... G03G/15/08 |
| JP | 11065255 | A | * 3/1999 | ..... G03G/15/08 |

OTHER PUBLICATIONS

Sato et al., "Electrophotographic Recording Apparatus", Oct. 1991, JP03233487A (translation), p. 10, lines 2–18.*

* cited by examiner

*Primary Examiner*—Susan Lee
(74) *Attorney, Agent, or Firm*—John A. Brady

(57) ABSTRACT

Artificial toner consumption is triggered to minimize the incidence of "conditioned" toner when a comparison of the rate of toner consumption to the mechanical activity of the electrophotographic printing device indicates that the toner consumption rate is too low. The artificial toner consumption operation may be achieved through a dummy print operation where an intentionally un-printed image is formed on a photoconductive drum, but the corresponding toner is routed to appropriate waste toner reservoir(s) and the image is not printed on the recording medium. The dummy print toner may be cleaned from the photoconductive drum without being transferred to an intermediate transfer medium and/or may be cleaned from the intermediate transfer medium, both without transferring the toner to the recording medium. The dummy print operation may correspond to a next normally occurring interdocument gap or a dedicated dummy print period inserted between print jobs.

32 Claims, 4 Drawing Sheets

METHOD OF COMPENSATING FOR LOW TONER CONSUMPTION

BACKGROUND OF THE INVENTION

The present invention relates generally to the field of electrophotographic image forming, and more particularly to a method of promoting good image quality by compensating for undesirably low toner consumption.

The quality of printing produced by an electrophotographic printing process is governed by a number of factors, including the choice of the particular electrophotographic printing process used, the alignment of various mechanical components, and the properties of the toner being employed. In turn, factors helping to determine the properties of the toner include the chemical composition of the toner, its particle size, and its process/environmental history. With particular regard to the present invention, it has been noticed that when an electrophotographic printing device is called on to produce output with very low print factor for a prolonged period, the print quality suffers. It has been proposed that one reason for this phenomenon is that the low toner usage that accompanies prolonged low print factor printing results in "conditioning" of the toner, leading to reduced print quality.

Several approaches have been proposed to address this situation. One example is disclosed in U.S. Pat. No. 5,168,293 which addresses this problem by tracking the print factor on a pixel-by-pixel basis between various size print media. When the pixel-by-pixel print factor falls too low, the '293 device forcibly consumes toner to bring the pixel-by-pixel print factor back to at least the desired minimum level. However, this approach's reliance on pixel-by-pixel tracking of toner usage consumes substantial memory and processing power that could be otherwise used within the electrophotographic printing device. Also, the approach relies on a complex computation of available print area for various sized print media, further consuming computational resources. As such, there remains a need for other approaches to compensating for low toner usage.

SUMMARY OF THE INVENTION

The present invention monitors the rate of toner consumption with respect to mechanical activity of the electrophotographic printing device in order to minimize the incidence of "conditioned" toner by triggering an artificial toner consumption operation when the toner consumption rate is too low.

One embodiment of the present invention is a method of controlling an electrophotographic printing assembly that comprises measuring mechanical activity of the printing assembly, monitoring a rate of consumption of toner; and then forcing artificial consumption of toner in response to the rate failing to satisfy a predetermined threshold with respect to the mechanical activity. The artificial toner consumption may be achieved though a dummy print operation where an intentionally un-printed latent image is formed on a photoconductive drum, but the corresponding toner rendering the latent image visable is routed to appropriate waste toner reservoir(s) and the image is not printed on the recording medium (e.g., paper). The dummy print toner may be cleaned from the photoconductive drum without being transferred to an intermediate transfer medium and/or may be cleaned from the intermediate transfer medium, both without transferring the toner to the recording medium.

A controller may time the dummy print operation to correspond to a next normally occurring interdocument gap or may adjust the printing process such that a dedicated dummy print period is inserted between print jobs. Also, the monitoring of printer mechanical activity and rate of toner consumption may be done with respect to the printer as a whole or on a toner cartridge-by-toner cartridge basis, as desired.

DETAILED DESCRIPTION OF THE INVENTION

As the present invention relates to the usage of toner in an electrophotographic image forming apparatus, an understanding of the basic elements of an electrophotographic image forming apparatus may aid in understanding the present invention. For purposes of illustration, a four cartridge color laser printer will be described; however one skilled in the art will understand that the present invention is applicable to other types of electrophotographic image forming apparatuses that use one or more toner colors for printing. Further, for simplicity, the discussion below may use the terms "sheet" and/or "paper" to refer to the recording media 5; this term is not limited to paper sheets, and any form of recording media is intended to be encompassed therein, including without limitation, envelopes, transparencies, postcards, and the like.

Figure 1:
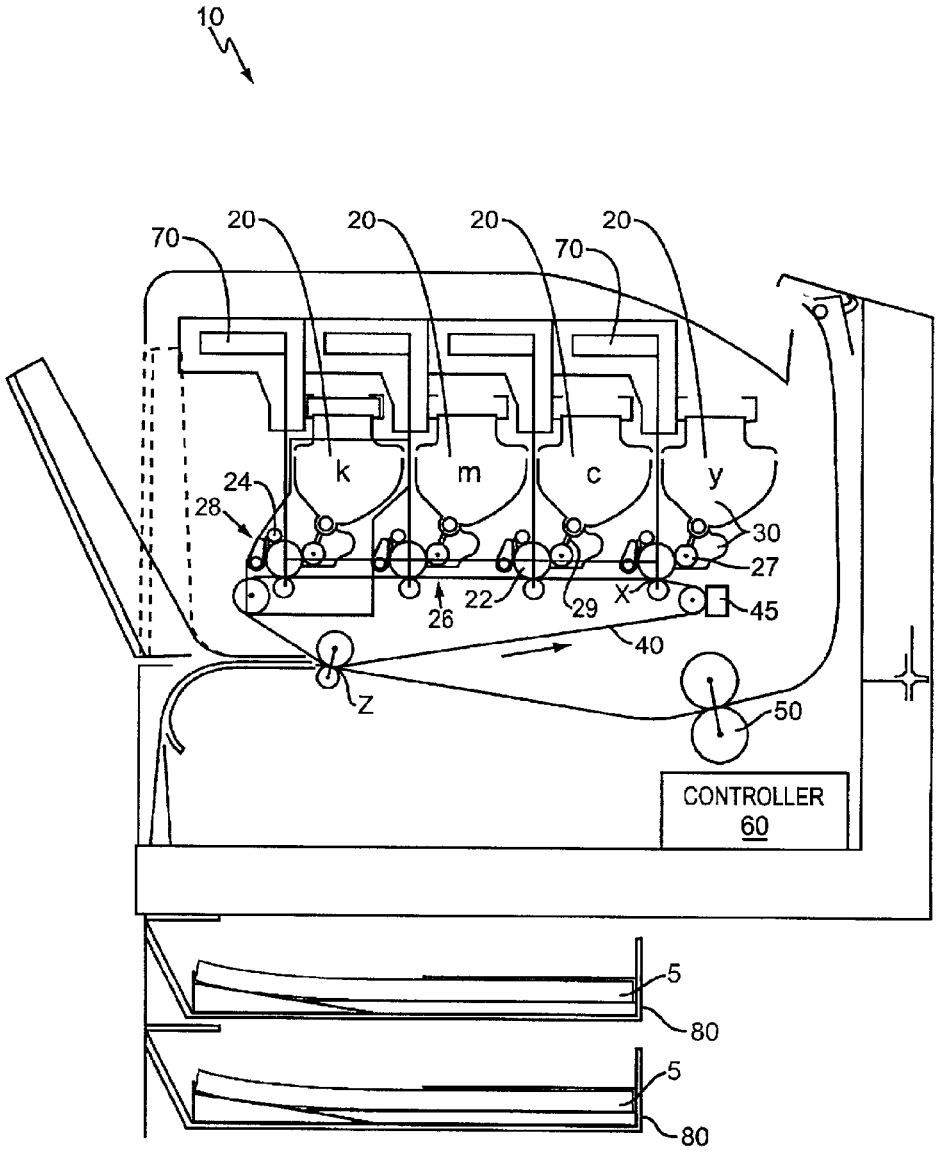
FIG. 1 shows an image forming apparatus that may employ the present invention.

A four color laser printer, generally designated 10 in FIG. 1, typically includes a plurality of optionally removable toner cartridges 20 that have different color toner contained therein, an intermediate transfer medium 40, a fuser 50, and one or more recording media supply trays 80. For instance, the printer 10 may include a black (k) cartridge 20, a magenta (m) cartridge 20, a cyan (c) cartridge 20, and a yellow (y) cartridge 20. Typically, each different color toner forms an individual image of a single color that is combined in a layered fashion to create the final multi-colored image, as is well understood in the art. Each of the toner cartridges 20 may be substantially identical; for simplicity only the operation of the cartridge 20 for forming yellow images will be described, it being understood that the other cartridges 20 may work in a similar fashion.

The toner cartridge 20 typically includes a photoconductor 22 (or "photoconductive drum" or simply "PC drum"), a charger 24, a developer section 26, a cleaning assembly 28, and a toner supply bin 30. The photoconductor 22 is generally cylindrically-shaped with a smooth surface for receiving an electrostatic charge over the surface as the photoconductor 22 rotates past charger 24. The photoconductor 22 rotates past a scanning laser 70 directed onto a selective portion of the photoconductor surface forming an electrostatically latent image representative of the image to be printed. Drive gears (not shown) may rotate the photoconductor 22 continuously so as to advance the photoconductor 22 some uniform amount, such as $1/600$th or $1/1200$th of an inch, between laser scans. This process continues as the entire image pattern is formed on the surface of the photoconductor 22.

After receiving the latent image, the photoconductor 22 rotates to the developer section 26 which has a toner bin 30 for housing the toner and a developer roller 27 for uniformly transferring toner to the photoconductor 22. The toner is typically transferred from the toner bin 30 to the photoconductor 22 through a doctor blade nip formed between the developer roller 27 and the doctor blade 29. The toner is typically a fine powder constructed of plastic granules that are attracted and cling to the areas of the photoconductor 22 that have been discharged by the scanning laser 70. To prevent toner escape around the ends of the developer roller 27, end seals may be employed, such as those described in U.S. patent applications Ser. Nos. 09/833,888 and 09/965,266, which are commonly owned and incorporated herein by reference. In addition, a flexible lower developer roller seal 29*a* (FIG. 2) may be employed as known in the art.

The photoconductor 22 next rotates past an adjacently-positioned intermediate transfer medium ("ITM"), such as belt 40, to which the toner is transferred from the photoconductor 22. The location of this transfer from the photoconductor 22 to the ITM belt 40 is called the first transfer point (denoted X in FIG. 1). After depositing the toner on the ITM belt 40, the photoconductor 22 rotates through the cleaning section 28 where residual toner is removed from the surface of the photoconductor 22, such as via a cleaning blade well known in the art. The residual toner may be moved along the length of the photoconductor 22 to a waste toner reservoir (not shown) where it is stored until the cartridge 20 is removed from the printer 10 for disposal. The photoconductor 22 may further pass through a discharge area (not shown) having a lamp or other light source for exposing the entire photoconductor surface to light to remove any residual charge and image pattern formed by the laser 70.

As illustrated in FIG. 1, the ITM belt 40 is endless and extends around a series of rollers adjacent to the photoconductors 22 of the various cartridges 20. The ITM belt 40 and each photoconductor 22 are synchronized by controller 60, via gears and the like well known in the art, so as to allow the toner from each cartridge 20 to precisely align on the ITM belt 40 during a single pass. By way of example as viewed in FIG. 1, the yellow toner will be placed on the ITM belt 40, followed by cyan, magenta, and black. The purpose of the ITM belt 40 is to gather the image from the cartridges 20 and transport it to the sheet 5 to be printed on.

The paper 5 may be stored in paper supply tray 80 or a manual paper feed station and supplied, via a suitable series of rollers, belts, and the like, to the location where the sheet 5 contacts the ITM belt 40. At this location, called the second transfer point (denoted Z in FIG. 1), the toner image on the ITM belt 40 is transferred to the sheet 5. If desired, the sheet 5 may receive an electrostatic charge prior to contact with the ITM belt 40 to assist in attracting the toner from the ITM belt 40. The sheet 5 and attached toner next travel through a fuser 50, typically a pair of rollers with an associated heating element, that heats and fuses the toner to the sheet 5. The paper 5 with the fused image is then transported out of the printer 10 for receipt by a user. After rotating past the second transfer point Z, the ITM belt 40 is cleaned of residual toner by an ITM cleaning assembly 45 so that the ITM belt 40 is clean again when it next approaches the first transfer point X.

Figure 2:
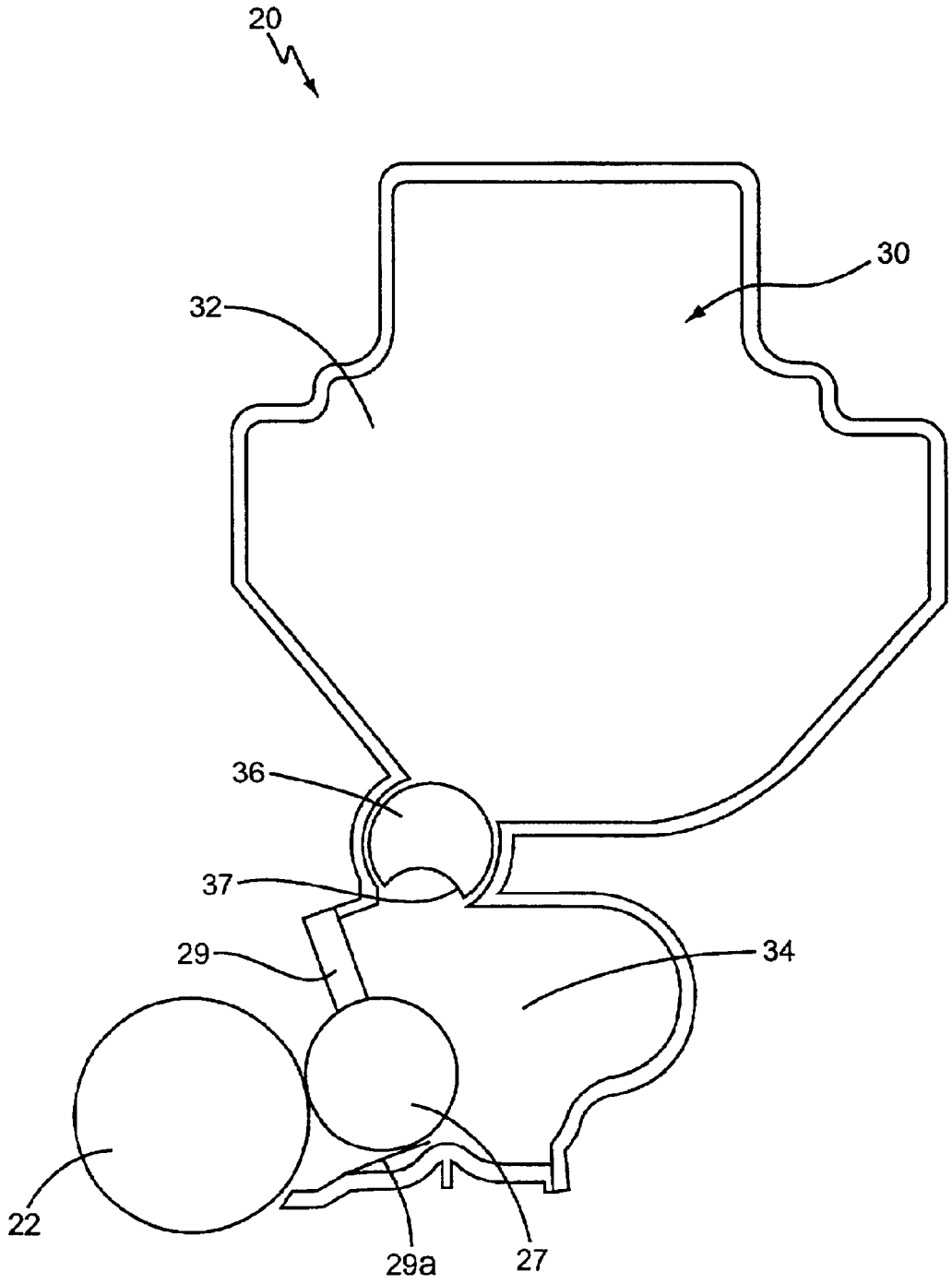
FIG. 2 shows a more detailed view of a toner cartridge of FIG. 1.

An exemplary toner cartridge 20 is shown in further detail in FIG. 2. As discussed above, the toner cartridge 20 typically includes a PC drum 22, a developer section 26, and a toner supply bin 30. As shown in FIG. 2, the toner supply bin 30 may be divided into two sections—an upper chamber, referred to as the toner supply reservoir 32, and a lower chamber, referred to as the developing chamber 34 (which also forms part of developing section 26). The developing chamber 34 contains the developer roller 27 which acts to position toner to develop a latent image on the PC drum 22. The toner supply reservoir 32 stores toner that is supplied to the developing chamber 34 by a toner supply mechanism 36 during operation of the printer 10. In FIG. 2, the toner supply mechanism 36 takes the form of a toner meter 36 that separates the toner supply reservoir 32 from the developing chamber 34. This architecture reduces the static pressure of the toner on the nip between the doctor blade 29 and the developer roller 27, as discussed in U.S. patent application Ser. No. 09/838,353, which is incorporated herein by reference. The toner meter 36 may comprise a rotating cylinder with a scoop 37 formed on the outer surface of the cylinder, but this configuration is not required. The toner meter 36 of FIG. 2 transfers one scoop full of toner to the developing chamber 34 with each rotation. One rotation of the toner meter 36 is referred to herein as a toner meter cycle. A counter 38 maintains a count of the toner meter cycles. In some embodiments, rotation of the toner meter 36 closes an electro-mechanical switch connected to the counter 38, which then increments the count. During operation of the printer 10, a low toner sensor 35, which may be electrical and/or mechanical as desired, detects the level of toner in the developing chamber 34. When the low toner sensor 35 notes that toner in the developing chamber 34 is low, the low toner sensor 35 and/or the controller 60 causes a request/demand for additional toner to be sent to the toner meter 36. In response to the request/demand, the toner meter 36 is activated to transfer toner from the toner supply reservoir 32 to the developing chamber 34.

When toner in the developing chamber 34 is subjected to prolonged agitation, the toner may become "conditioned," resulting in degraded print quality. This conditioning is believed to be caused primarily by the physical and/or electrical interaction of the toner with the rotating developer roller 27 and related parts. Such a situation is particularly true for very low coverage rates, such as 1–5%. The present invention helps minimize the incidence of "conditioned" toner by forcing artificial consumption of the toner when consumption of toner would otherwise be too low, so that the resulting overall toner consumption rate meets a desired minimum level of consumption. In particular, the method monitors a mechanical activity (B) of the printer and compares this activity to the rate of toner consumption (A) from the developing chamber 34. When the ratio of the two (A:B) falls below the threshold level (T), the controller 60 forces the printer 10 to artificially "waste" toner via what may be termed a "dummy print" operation.

Figure 3:
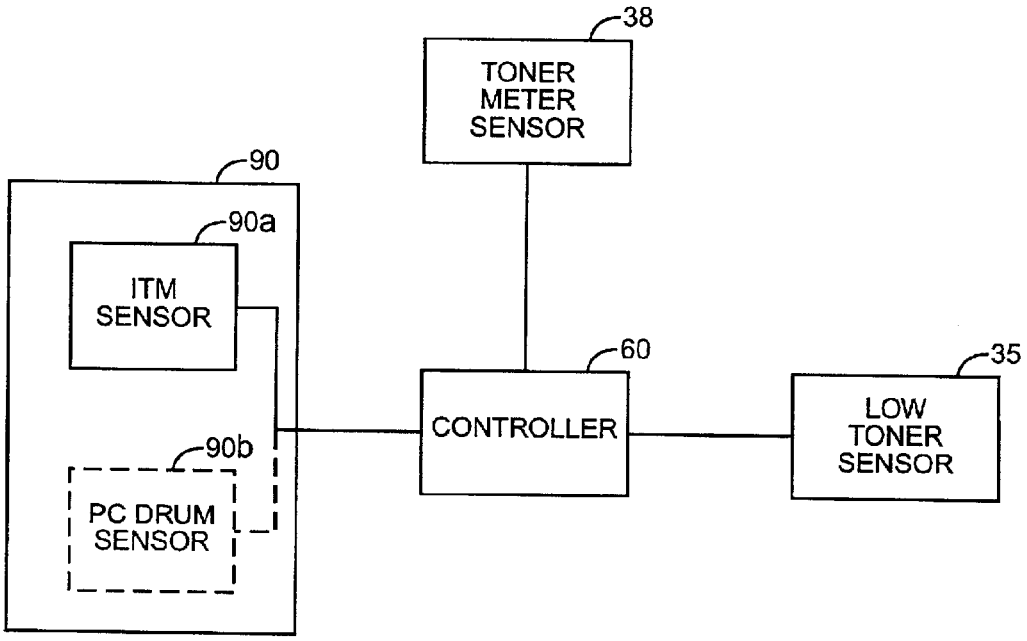
FIG. 3 shows the controller of FIG. 1 connected to several sensors useful for collecting information to carry out the method of the present invention.

The controller 60 controls the general process flow, shown in FIG. 4 and discussed further below, based on process information collected from a number of sensors. Referring to FIG. 3, the controller 60 is operatively connected to low toner sensor 35 to aid in triggering a toner meter cycle when appropriate, and to the sensor or counter 38 that maintains a count of the toner meter cycles. Controller 60 is also connected to sensor 90 for monitoring the mechanical activity of the electrophotographic printing assembly 10. In exemplary embodiments, this sensor 90 may take the form of sensor 90*a* which monitors the number of revolutions of the ITM belt 40, or take the form of sensor 90*b* which monitors the number of revolutions of PC drum 22. These sensors 90*a*, 90*b* may detect the passage of some reference mark, may be tied to the appropriate drive motors, or may take any other form known in the art for tracking physical movement of components in the printer 10—sometimes referred to herein as "mechanical activity of the printing assembly." Note that printer mechanical activity monitored by sensor 90 does not encompass pixel-by-pixel computation of actual printed image coverage or print factor.

Figure 4:
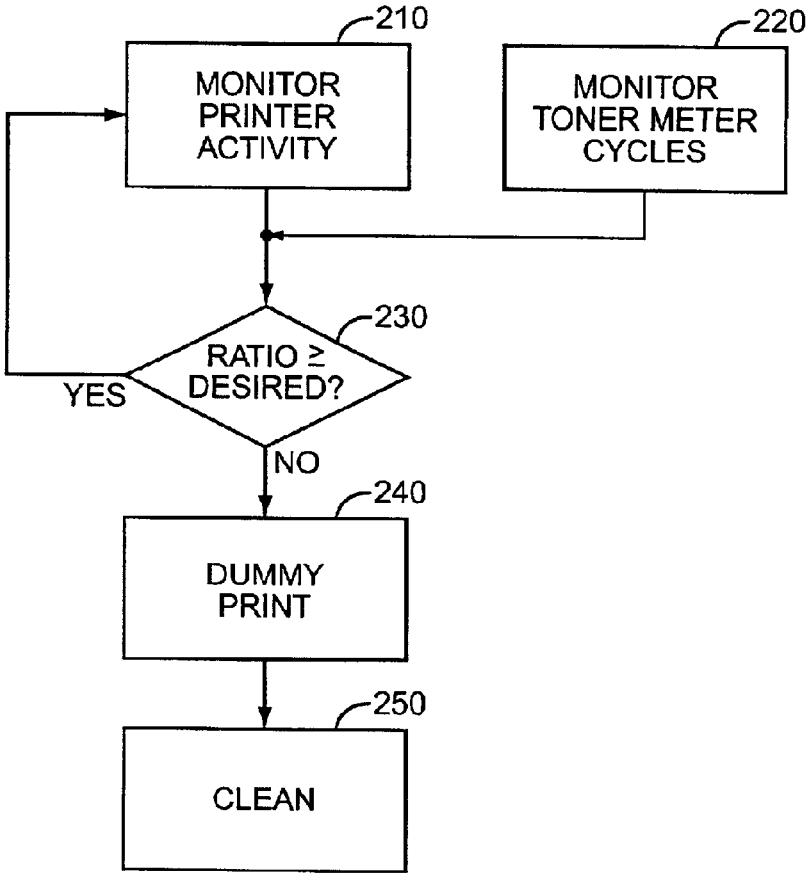
FIG. 4 shows the process flow of one embodiment of the present invention.

Referring to FIG. 4, the process of the present invention includes monitoring the amount of mechanical activity of the printer (block 210). As discussed above, this monitoring may, for example, take the form of noting the number of ITM belt revolutions based on sensor 90*a*, noting the number of PC drum revolutions based on sensor 90*b*, or some other measure of printer mechanical activity that is not based on percent coverage printed, computed on a pixel-by-pixel basis or otherwise. In addition, the consumption of toner is monitored via sensor 38 (block 220), in this embodiment by checking the number of requests for supply of toner from the toner supply reservoir 32 to the developing chamber 34 based on the number of toner meter cycles. The controller 60 then compares the number of toner meter cycles (A) to the amount of mechanical activity (B) (block 230). If the ratio of toner meter cycles to mechanical activity (A:B) is above a predetermined threshold, indicating that a sufficiently high level of toner consumption is occurring, then the process loops back. If, on the other hand, the ratio of toner meter cycles to mechanical activity is not above the threshold, indicating that the toner consumption rate is too low, then controller 60 triggers a dummy print operation (block 240). In one embodiment, the dummy print operation involves forming a latent image on the PC drum 22 to develop the image, applying toner to the PC drum 22, but not transferring the toner the ITM belt 40. The transfer of toner from the PC drum 22 to the ITM belt 40 may be prevented through adjustment of bias levels between the two, or by any other method known in the art. The waste toner is then removed from the PC drum 22 at the PC drum cleaning station 28 in a known fashion (block 250). In another embodiment, dummy print operation involves forming a latent image on the PC drum 22, applying toner to the PC drum 22 to develop the image, transferring the image to the ITM belt 40, but not transferring the toner of the image from the ITM belt 40 to the paper 5. The waste toner is then removed from the ITM belt 40 at the ITM cleaning station 45 in a known fashion (block 250). In yet another embodiment, the two approaches to dummy printing described immediately above are combined such that some toner is transferred from the PC drum 22 to the ITM belt 40, and some is not, thereby sharing the waste toner generated by the dummy print operation between a plurality of waste toner reservoirs. One common aspect of the embodiments described above is that toner is artificially consumed during a dummy print operation by forming an intentionally un-printed image on the PC drum 22 and then routing the corresponding toner to appropriate waste toner reservoir(s). If the dummy print operation does not raise the toner consumption level to the desired level, the dummy print operation may be repeated until the proper level is met.

The controller 60 may advantageously control the timing of the dummy print operation such that the dummy printing occurs during the next normally occurring interdocument gap. Alternatively, the controller 60 may adjust the printing process such that a dedicated dummy print period is inserted between print jobs, but this may undesirably slow throughput. Further, it may be advantageous for the controller 60 to generally suspend toner supply operations to the developing chamber 34, such as halting toner addition cycles by the toner meter 36, until after the completion of the dummy print operation so as to avoid wasting "new" toner during the dummy print operation.

It should be noted that if there is a transfer roller associated with the ITM belt 40 that may come into contact with the dummy print toner, such as one at the second transfer point Z, it may be advantageous to clean this transfer roller or otherwise take steps to avoid contaminating "real" print output with residue from the dummy print. For instance, it may be advantageous to alternate bias levels associated with the transfer roller between two widely spaced values (e.g., −500 V and +2500 V) with several revolutions of the transfer roller at each bias level. Alterntatively, the transfer roller may be controlled to mechanically disengage from the ITM belt 40 when the dummy print toner is present, allowing the dummy print toner to travel to the ITM cleaning station 45 without contaminating the transfer roller. The former approach may be better suited to dedicated dummy print periods while the latter approach may be better suited to dummy printing during interdocument gaps.

For the embodiments described above, the dummy print operation involves forming a dummy print image on the PC drum 22. This dummy print image may be a fixed, predefined print image of a known size. Alternatively, the particular size and/or density of dummy image formed may be a function of the amount of dummy print desired. For instance, if the desired minimum toner consumption rate conceptually corresponds to 10% print factor, and the ratio of toner meter cycles to printer mechanical activity indicates a significantly lower rate (e.g., conceptually corresponding to 7% print factor), then a relatively dense image may be used for the dummy print operation. On the other hand, if the ratio of toner meter cycles to printer mechanical activity indicates only a slightly lower rate (e.g., conceptually corresponding to 9% print factor), then a less dense image may be used for the dummy print operation. Whatever size/density of dummy print image is used, it may be advantageous to ensure that the dummy print image formation process requires multiple revolutions of the developer roller 27 (e.g., three or more) to aid purging the "conditioned" toner from the developing chamber 34. Also, the maximum amount of toner consumed by the dummy print operation may be limited to an amount corresponding to a desired maximum amount, such as an amount corresponding to 5%, to avoid wasting too much toner.

For simplicity, the discussion above has focused on a single toner cartridge 20. However, the present invention also covers printers 10 with multiple toner cartridges 20. For such printers 10, the same general approach is followed, with the monitoring of printer mechanical activity (block 210) and the toner consumption rate (block 220) done with respect to the printer as a whole or on a cartridge-by-cartridge basis, as desired. Accordingly, it should be understood that the present invention is intended to cover printers 10 with single toner cartridges 20 and plural toner cartridges 20.

As can be seen from the discussion above, the relevant "toner consumption rate" for the present invention is with respect to some repeated mechanical activity of the printer, such as rotations of a photoconductor 22 or drive motor, and not with respect to time. For some embodiments of printer 10 with multiple toner cartridges 20 employing the present invention, such as the four color example of FIG. 1, the printer is capable of selectively disengaging the drive mechanisms of the toner cartridges 20, either individually or in groups. For instance, the printer 10 may be able to disengage the drive mechanisms of the toner cartridges 20 with color toner therein when only black printing is required. In such situations, the present invention may advantageously ignore any mechanical activity occurring while the drive mechanisms are disengaged, at least with respect to the corresponding toner cartridges 20. This approach is particularly relevant when the mechanical activity is based on rotations of the ITM belt 40.

The discussion above has used toner meter cycles as an exemplary measure of toner consumption. However, other measures of toner consumption are also intended to be encompassed. For instance, toner consumption (A) may be monitored by sensing the number of turns of a toner supply auger, or any other toner supply mechanism known in the art. Likewise, the discussion above has used revolutions of the PC drum 22 or the ITM belt 40 as exemplary measures of mechanical activity of the printer. However, the number of pages printed may also used as an alternate measure of mechanical activity of the printer (B), and is intended to be encompassed by the present invention. Accordingly, the threshold value (T), representing the ratio A:B between toner consumption and mechanical activity may be a predetermined value expressed in any suitable way known in the art (e.g., fraction, decimal, etc. in units of grams/revolution, toner addition cycles/page, etc.).

By using the approach of the present invention, the toner used for "real" printing is kept from being conditioned by artificially removing "stale" toner from the developing chamber and replacing it with "new" toner from the toner supply reservoir.

As used herein, the terms "electrophotographic printing device" and "electrophotographic printing assembly" should be broadly construed; specifically including, but not limited to, laser printers, facsimile machines, copiers, and the like that use an electrophotographic image forming process of any variety.

Although the present invention has been described herein with respect to particular features, aspects and embodiments thereof, it will be apparent that numerous variations, modifications, and other embodiments are possible within the broad scope of the present invention, and accordingly, all variations, modifications and embodiments are to be regarded as being within the scope of the invention. For instance, some embodiments of the printer 10 may use a photoconductor 22 that transfers toner directly to the paper 5, rather than relying on an intermediate transfer medium 40. The present embodiments are therefore to be construed in all aspects as illustrative and not restrictive and all changes coming within the meaning and equivalency range of the appended claims are intended to be embraced therein.

What is claimed is:

1. A method of controlling an electrophotographic printing assembly, comprising:

measuring mechanical activity of the printing assembly;

monitoring the number of times a toner supply mechanism is activated with respect to said mechanical activity to determine a rate of consumption of toner with respect to said mechanical activity; and forcing artificial consumption of toner in response to said rate failing to satisfy a predetermined threshold.

2. The method of claim 1 wherein forcing artificial consumption of toner comprises performing a dummy print operation.

3. The method of claim 1 wherein forcing artificial consumption of toner comprises:

forming an image with toner on a photoconductive member; and cleaning said toner corresponding to said image from said photoconductive member without transferring said image to an intermediate transfer medium or a recording medium.

4. The method of claim 1 wherein forcing artificial consumption of toner comprises:

forming an image with toner on a photoconductive member;

forming an image with toner on a photoconductive member;

transferring said toner corresponding to said image from said photoconductive member to an intermediate transfer member; and cleaning said toner corresponding to said image from said intermediate transfer member without transferring said image to a recording medium.

5. The method of claim 1 wherein forcing artificial consumption of toner comprises consuming toner during an interdocument gap without forming a corresponding image on a recording medium.

6. The method of claim 1 wherein forcing artificial consumption of toner comprises consuming toner during an interruption of normal printing without forming a corresponding image on a recording medium.

7. The method of claim 1 wherein measuring mechanical activity of the printing assembly comprises measuring the number of rotations of a mechanical component within said printing assembly.

8. The method of claim 7 wherein the mechanical component comprises a photoconductive drum.

9. The method of claim 7 wherein the mechanical component comprises an intermediate transfer medium.

10. The method of claim 1 wherein said threshold is a ratio of activations of a toner supply mechanism to rotations of a photoconductive member.

11. The method of claim 1 wherein said threshold is a ratio of activations of a toner supply mechanism to rotations of an intermediate transfer medium.

12. The method of claim 1 wherein the electrophotographic printing assembly comprises a plurality of toner cartridges, and further comprising on a cartridge-by-cartridge basis:

measuring a mechanical activity of the corresponding cartridge;

monitoring a rate of consumption of toner by the corresponding cartridge with respect to said mechanical activity; and forcing artificial consumption of toner from the corresponding cartridge in response to said rate failing to satisfy a predetermined threshold.

13. The method of claim 1 wherein measuring mechanical activity of the printing assembly comprises measuring the number of pages printed.

14. A method of controlling an electrophotographic printing assembly, comprising:

monitoring demand for supply of toner (A); and monitoring revolutions of a photoconductive drum of the printing assembly (B);

establishing a desired minimum threshold ratio A to B; and triggering an artificial consumption of toner in response to said demand being less than A for B revolutions of said photoconductive drum.

15. The method of claim 14 wherein said artificial consumption of toner comprises:

forming an image with toner on a photoconductive member; and cleaning said toner corresponding to said image from said photoconductive member without transferring said image to an intermediate transfer medium or a recording medium.

16. The method of claim 14 wherein said artificial consumption of toner comprises:

forming an image with toner on a photoconductive member;

transferring said toner corresponding to said image from said photoconductive member to an intermediate transfer member; and cleaning said toner corresponding to said image from said intermediate transfer member without transferring said image to a recording medium.

17. The method of claim 14 wherein said artificial consumption of toner comprises consuming toner during an interdocument gap without forming a corresponding image on a recording medium.

18. The method of claim 14 wherein said artificial consumption of toner comprises consuming toner during an interruption of normal printing without forming a corresponding image on a recording medium.

19. The method of claim 14 wherein monitoring a demand for supply of toner comprises monitoring the number of times a toner supply mechanism is activated.

20. A method of controlling an electrophotographic printing assembly, said assembly comprising at least one toner cartridge having a toner supply reservoir connecting to a developing chamber via toner supply mechanism; said method comprising:

consuming toner from said developing chamber to produce images on one or more recording media via a photoconductive member;

measuring mechanical movement of an intermediate transfer medium (ITM);

monitoring requests for supply of additional toner from said toner supply reservoir to said developing chamber;

comparing a rate of said requests with respect to said mechanical movement to a predetermined threshold; and triggering artificial consumption of toner from said developing chamber in response to said rate failing to satisfy said predetermined threshold.

21. The method of claim 20 wherein forcing artificial consumption of tenor forming an image with toner on said photoconductive member; and cleaning said toner corresponding to said image from said photoconductive member without transferring said image to said ITM or a recording medium.

22. The method of claim 20 wherein forcing artificial consumption of toner comprises:

forming an image with toner on said photoconductive member;

transferring said toner corresponding to said image from said photoconductive member to said ITM; and cleaning said toner corresponding to said image from said ITM without transferring said image to a recording medium.

23. The method of claim 20 wherein said artificial consumption of toner comprises:

forming a latent image on said photoconductive member;

cleaning a first portion of toner corresponding to said image from said photoconductive member; and cleaning a second portion of toner corresponding to said image, being the remainder of said toner corresponding to said image, from said ITM.

24. An electrophotographic printing assembly; comprising:

at least one toner cartridge having a toner supply reservoir connecting to a developing chamber;

a first sensor operative to detect mechanical movement of an element in said assembly;

a second sensor operative to detect the supply of additional toner from said toner supply reservoir to said developing chamber;

a controller operatively connected to said first and second sensors and programmed to cause artificial consumption of toner from said developing chamber in response to a rate of said toner supply with respect to said mechanical movement failing to satisfy a predetermined threshold.

25. The assembly of claim 24 wherein said cartridge further comprises a toner supply mechanism and wherein said second sensor detects an activation of said toner supply mechanism.

26. The assembly of claim 24 further comprising:

a photoconductive member connected to said toner cartridge;

an intermediate transfer medium connected to said photoconductive member; and wherein said artificial consumption of toner comprises forming a latent image on said photoconductive member and transferring less than all of said image to said intermediate transfer medium.

27. The assembly of claim 24 wherein said element whose movement is detected by said first sensor comprises a photoconductive drum.

28. The assembly of claim 24 wherein said element whose movement is detected by said first sensor comprises an intermediate transfer medium.

29. The assembly of claim 24 further comprising a plurality of said toner cartridges, each cartridge having a corresponding said first sensor operative to detect mechanical movement of a photoconductive drum associated with the respective cartridge; and wherein said controller is operatively connected to said plurality of first sensors.

30. A method of controlling an electrophotographic printing assembly, comprising:

measuring mechanical activity of the printing assembly;

monitoring a toner supply mechanism to determine a rate of consumption of toner with respect to said mechanical activity; and forcing artificial consumption of toner in response to said rate failing to satisfy a predetermined threshold, wherein said threshold is a ratio of activations of a toner supply mechanism to rotations of a photoconductive member.

31. A method of controlling an electrophotographic printing assembly, comprising:

measuring mechanical activity of the printing assembly;

monitoring a toner supply mechanism to determine a rate of consumption of toner with respect to said mechanical activity; and forcing artificial consumption of toner in response to said rate failing to satisfy a predetermined threshold, wherein said threshold is a ratio of activation of a toner supply mechanism to rotations of an intermediate transfer medium.

32. A method of controlling an electrophotographic printing assembly, comprising:

measuring mechanical activity of the assembly;

monitoring a toner supply mechanism to determine a rate of consumption of toner with respect to said mechanical activity, and forcing artificial consumption of toner in response to said rate failing to satisfy a predetermined threshold, wherein the electrophotographic printing assembly comprises a plurality of toner cartridges, and further comprising on a cartridge-by-cartridge basis:

measuring a mechanical activity of the corresponding cartridge;

monitoring a rate of consumption of toner by the corresponding cartridge with respect to said mechanical activity; and forcing artificial consumption of toner from the corresponding cartridge in response to said rate failing to satisfy a predetermined threshold.

* * * * *